US008627551B2

(12) United States Patent
Tseng

(10) Patent No.: US 8,627,551 B2
(45) Date of Patent: Jan. 14, 2014

(54) SEGMENT POSITIONING BELT

(75) Inventor: Hsin-Hsiang Tseng, Changhua (TW)

(73) Assignees: Hsin-Hsiang Tseng, Changhua, Changua County (TW); Taiwan Kuo Her Industrial Co., Ltd., Changhua, Changhua County (TW)

( * ) Notice: Subject to any disclaimer, the term of this patent is extended or adjusted under 35 U.S.C. 154(b) by 217 days.

(21) Appl. No.: 13/212,314

(22) Filed: Aug. 18, 2011

(65) Prior Publication Data

US 2013/0042446 A1 Feb. 21, 2013

(51) Int. Cl.
*A43C 11/00* (2006.01)
*A63C 9/24* (2012.01)

(52) U.S. Cl.
USPC ..... 24/68 SK; 24/591.1

(58) Field of Classification Search
USPC ..... 24/68 E, 68 R, 68 SK, 70 R, 70 SK, 170, 24/191, 69 SK, 71 SK, 591.1; 280/619, 634
See application file for complete search history.

(56) References Cited

U.S. PATENT DOCUMENTS

| | | | | |
|---|---|---|---|---|
| 5,852,852 | A * | 12/1998 | Rigal | 24/68 R |
| 6,374,464 | B1 * | 4/2002 | Lai | 24/68 SK |
| 6,481,070 | B2 * | 11/2002 | Caeran et al. | 24/712 |
| 6,510,717 | B1 * | 1/2003 | Levi | 70/18 |
| 7,121,122 | B2 * | 10/2006 | Levi | 70/18 |
| 7,454,932 | B2 * | 11/2008 | Hollier | 70/18 |
| 7,877,845 | B2 * | 2/2011 | Signori | 24/68 SK |
| 7,887,082 | B2 * | 2/2011 | Caslowitz | 280/619 |
| 8,201,308 | B2 * | 6/2012 | Caslowitz | 24/70 SK |
| 2005/0278901 | A1 * | 12/2005 | Huang | 24/16 R |
| 2008/0054600 | A1 * | 3/2008 | Caslowitz | 280/619 |
| 2011/0131772 | A1 * | 6/2011 | Caslowitz | 24/68 SK |
| 2013/0047388 | A1 * | 2/2013 | Kavarsky et al. | 24/68 SK |

* cited by examiner

*Primary Examiner* — Robert J Sandy
*Assistant Examiner* — Louis Mercado
(74) *Attorney, Agent, or Firm* — Egbert Law Offices, PLLC

(57) ABSTRACT

A segment positioning belt having a flexible belt body having a positioning end and an extension. A plurality of segment positioning portions are positioned in spaced relation to each other along the extension. A metal core is integrally formed into the belt body. The metal core extends within the positioning end and the extension of the belt body. The belt body has an elongated strip shape. The belt body is formed of a rubber or polymeric material.

8 Claims, 9 Drawing Sheets

SEGMENT POSITIONING BELT

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a segment positioning belt, and more particularly to an innovative one which is provided with strengthened metal cores.

2. Description of Related Art Including Information Disclosed Under 37 CFR 1.97 and 37 CFR 1.98.

The segment positioning belt of the present invention is widely applied for tightening/positioning of ski boots or bicycle carriers, etc.

Owing to the inherent flexibility, the segment positioning belt is provided with toothed or perforated segment positioning portions, which are mated with a positioner for the purpose of segment positioning.

In order to realize the flexibility and positioning, the belt body of a segment positioning belt is generally made of plastic or rubber materials. Yet, some problems are encountered in actual applications, such as: structural strength, endurance and safety. As mentioned above, there is a demanding safety requirement for the segment positioning belt since it is often applied for tightening/positioning of ski boots or bicycle carriers, etc. However, the plastic or rubber materials of the conventional segment positioning belt will gradually deteriorate to become fragile, leading to possible cracking or breakage or even safety hazards.

From another perspective, when said segment positioning belt is used for binding/positioning important objects, its plastic or rubber materials make it vulnerable to burglary, bringing about safety issues against theft.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The primary objective of the present invention is to provide an improved structure of segment positioning belt for ideal applications through research and development.

The present invention is characterized in that the segment positioning belt comprises a flexible belt body, formed into an elongated strip. The belt body made of plastic or rubber materials presents flexibility, and comprises a positioning end and an extension, of which the positioning end is provided with a mounting portion. Several segment positioning portions are set at interval onto the belt body along its extension. At least a strengthened metal core is integrally located into the belt body in an elongated form, so as to cover the positioning end and extension of the belt body. The present invention enables production of tensile stress against breakage of the belt body through arrangement of the strengthened metal core, making it possible to improve the endurance of the segment positioning belt, extend its service life and enhance the safety with better anti-burglary effects.

The enhanced efficacy of the present invention is as follows:

Based on the unique structure of the present invention wherein the "improved structure of a segment positioning belt" allows said strengthened metal core to be integrally located into the belt body of the segment positioning belt, the present invention enables production of tensile stress against breakage of the belt body through arrangement of the strengthened metal core, making it possible to improve the endurance of segment positioning belt, extend its service life and enhance the safety with better anti-burglary effects.

The improvements brought about by this invention are as follows:

Based on the structure wherein one end of the strengthened metal core of the belt body is coupled firmly with the looped portion or core tube/core bar, this could further enhance the strength of the mounting portion and strengthened metal core, such that the segment positioning belt can be used due to better endurance, service life, safety and anti-burglary performance.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
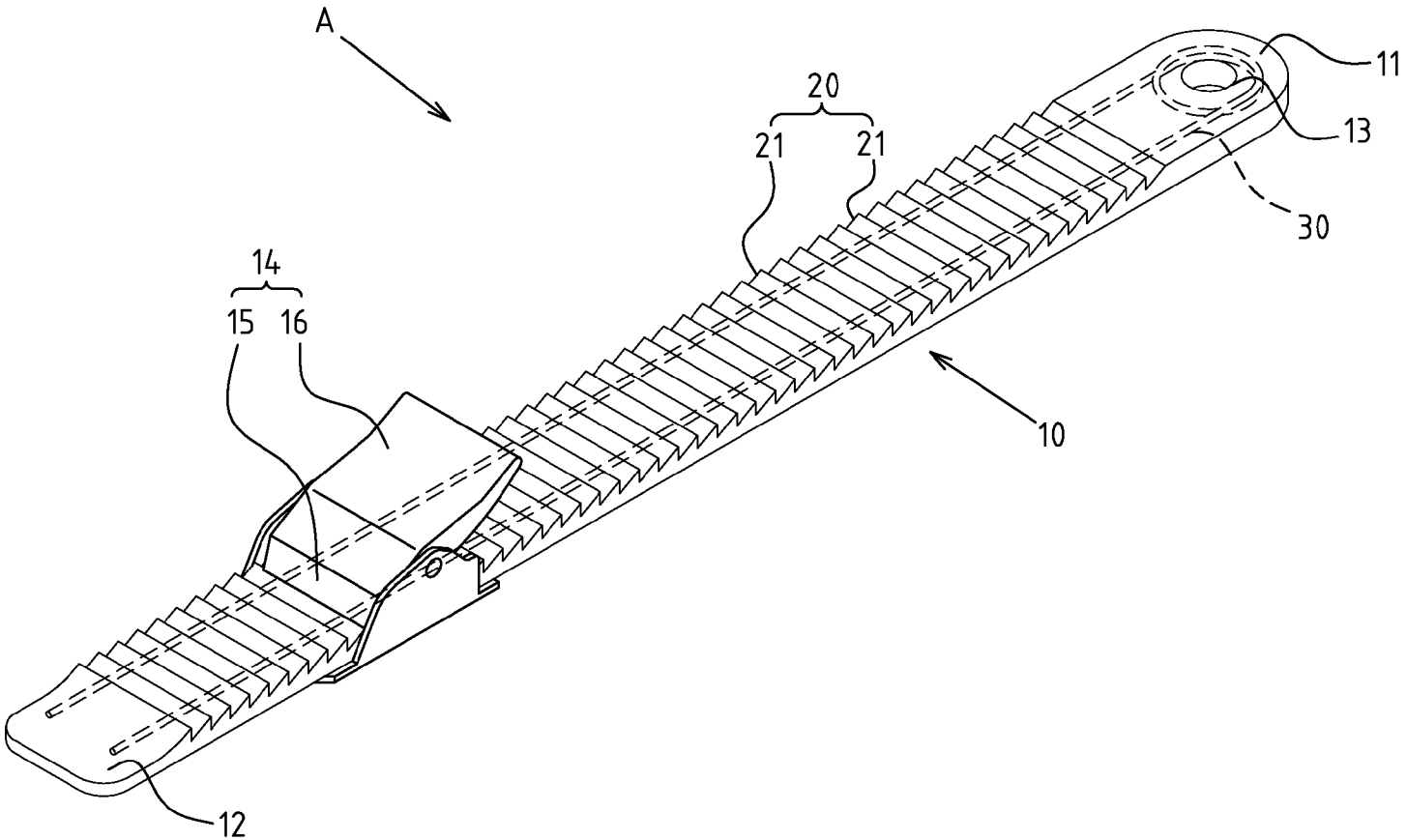
FIG. 1 is an assembled perspective view of the preferred embodiment of the segment positioning belt of the present invention.
Figure 2:
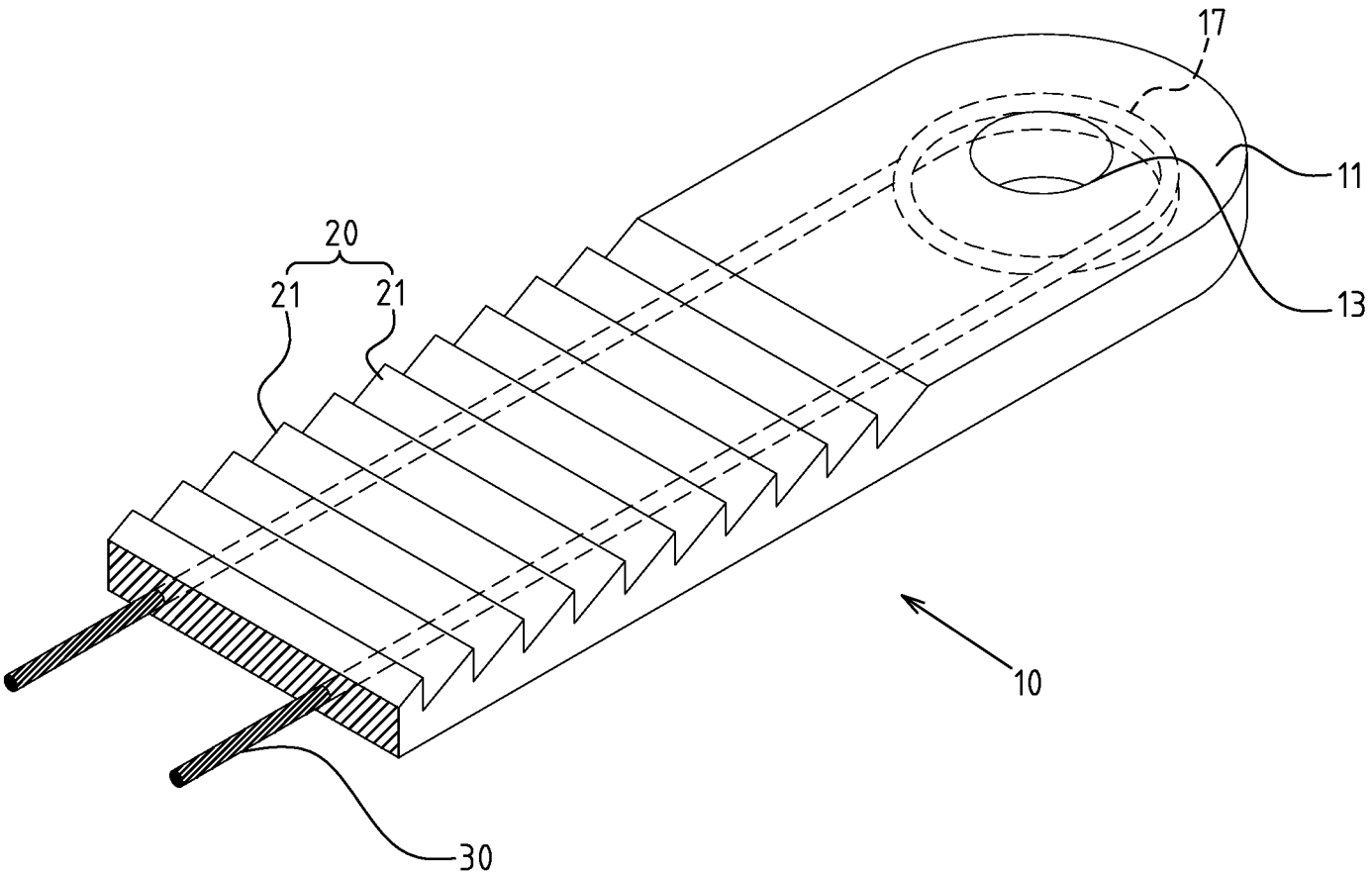
FIG. 2 is a sectional view of the preferred embodiment of the segment positioning belt of the present invention.

FIGS. 1 and 2 depict preferred embodiments of an improved segment positioning belt of the present invention, which, however, are provided for only explanatory objective for patent claims.

Said segment positioning belt A comprises a flexible belt body 10 configured into an elongated strip. The belt body is made of plastic or rubber materials and presents flexibility, and also comprises a positioning end 11 and an extension 12. The positioning end is provided with a mounting portion 13.

Several segment positioning portions 20 are set at interval onto the belt body 10 along its extension.

At least a strengthened metal core 30 is integrally located into the belt body in an elongated form, so as to cover the positioning end 11 and extension 12 of the belt body 10. The present invention enables production of tensile stress against breakage of the belt body 10. The strengthened metal core 30 is made of steel rope, but not limited to it.

Figure 9:
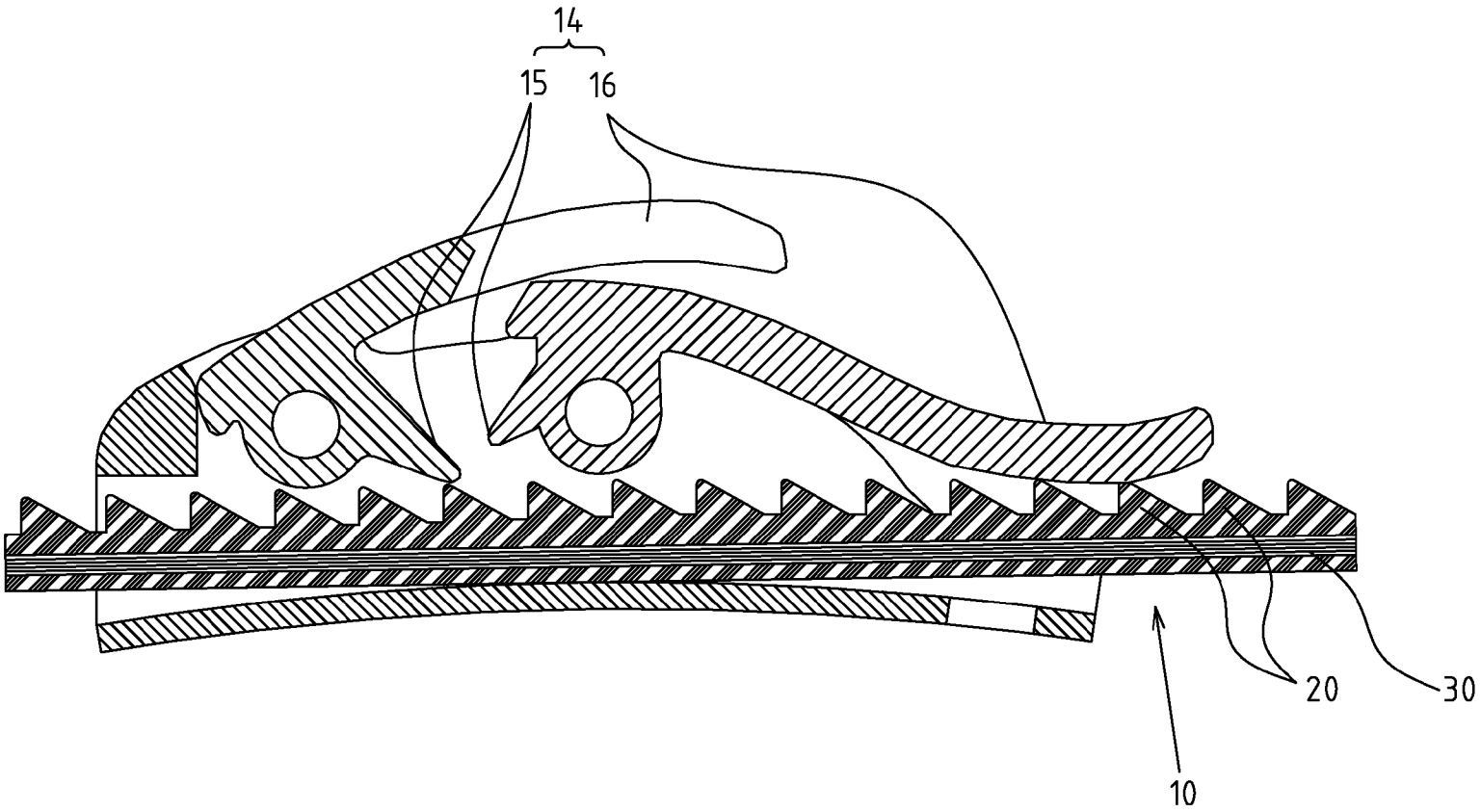
FIG. 9 is another schematic view of the positioning and release controller of the present invention.

Of which, a positioning and release controller 14 is set at one location of the belt body 10, and comprised of a snapper 15 and a controlling device 16. The snapper 15 could be embedded into any segment positioning portion 20 of the belt body 10 for the positioning purposes. The controlling device 16 is used to control the positioning or release state of the snapper 15. Moreover, the positioning and release controller 14 can also be comprised of two controlling devices 16 and two snappers 15 (shown in FIG. 9) for better embedding effect.

Figure 3:
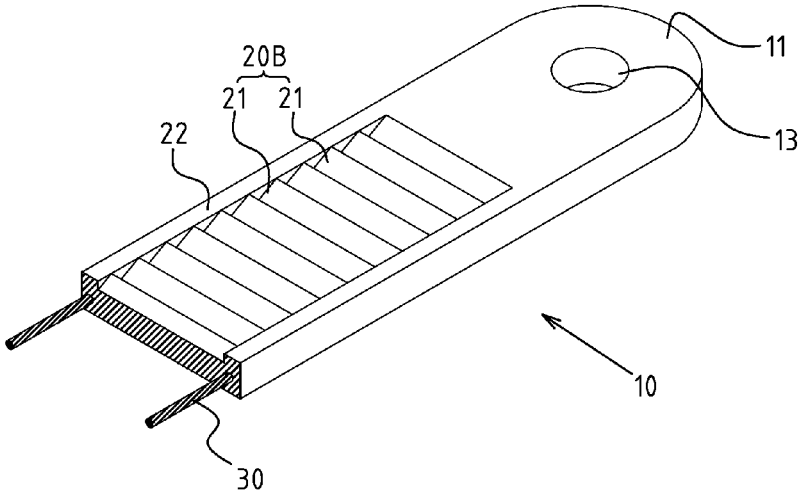
FIG. 3 is an application view of the present invention wherein the segment positioning portion is provided with a tip edge.
Figure 4:
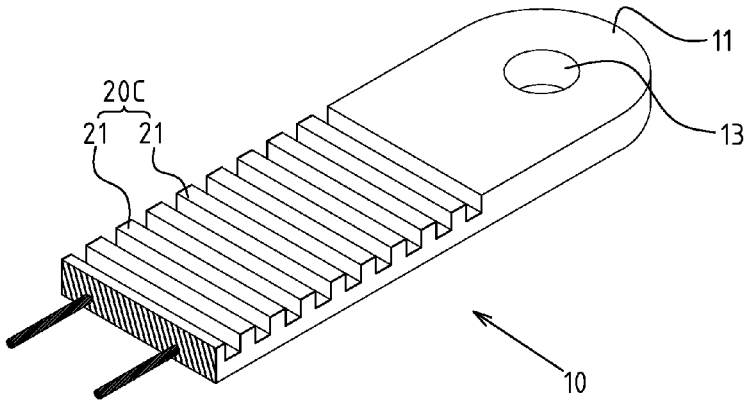
FIG. 4 is a schematic view of the present invention wherein the segment positioning portion is provided with a tip edge.

Referring to FIGS. 1 and 2, the segment positioning portion 20 of the belt body 10 has a toothed pattern. As for the toothed segment positioning portion 20, its tip edge 21 is as wide as that of the belt body 10 (shown in FIGS. 1, 2) or recessed into the belt body 10 (shown in FIG. 3). When the tip edge 21 of the segment positioning portion 20B shown in FIG. 3 is recessed into the belt body 10, two flanged portions 22 of bigger thickness are formed at both sides of the tip edge 21, such that the strengthened metal core 30 is set into the flanged portion 22. The cross section of said tip edge 21 has single-bevel triangular teeth (shown in FIG. 2), or the cross section of said tip edge 21 of the segment positioning portion 20C (shown in FIG. 4) is rectangular convex (concave) teeth.

Figure 5:
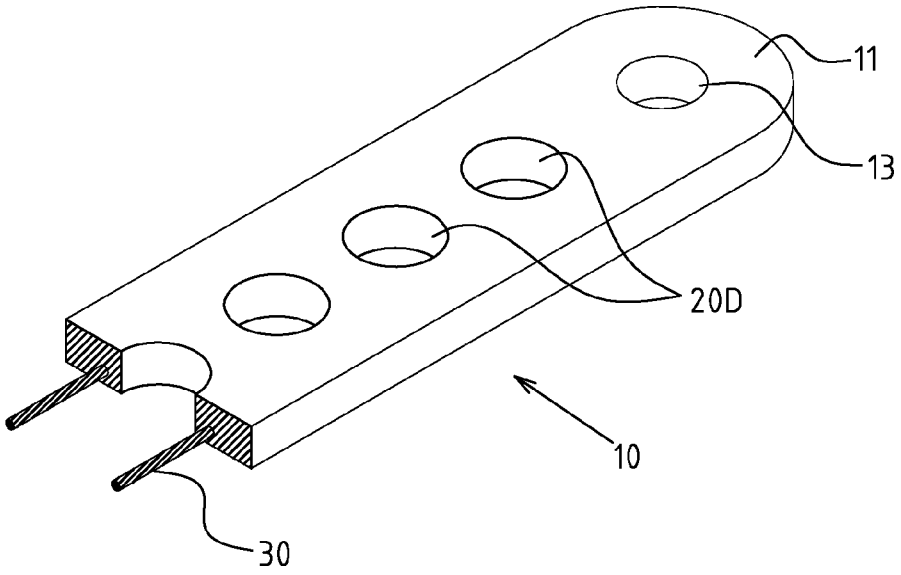
FIG. 5 is a schematic view of the present invention wherein the segment positioning portion has perforated holes.
Figure 6:
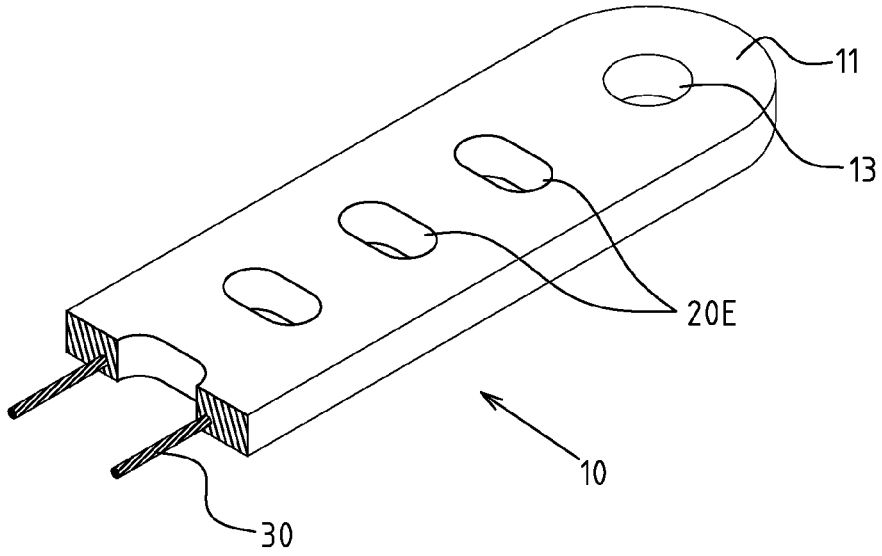
FIG. 6 is another schematic view of the present invention wherein the segment positioning portion has perforated holes.

Referring also to FIG. 5, the segment positioning portion 20D has perforated round holes. Referring also to FIG. 6, the segment positioning portion 20E has perforated long holes. The preferred embodiments in FIGS. 3-6 represent the multiple patterns of the segment positioning portion 20 of the belt body 10 in the present invention.

Figure 10:
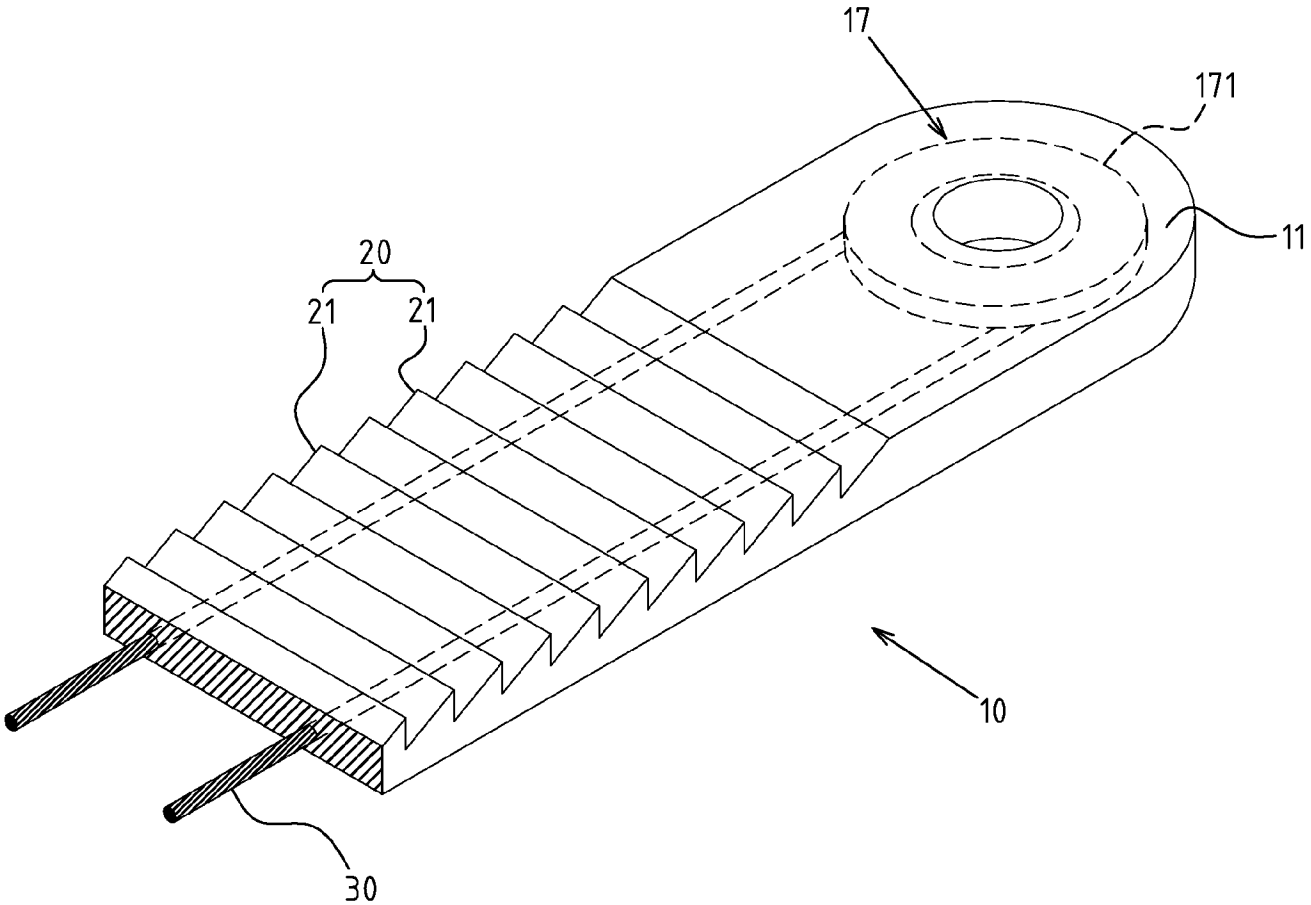
FIG. 10 is a schematic view of the present invention wherein the looped portion is formed by a looped metal element.

Of which, a looped portion 17 is set onto one end of the strengthened metal core 30 correspondingly to the mounting portion 13 at the positioning end 12 of the belt body 10, such that the mounting portion 13 is surrounded by the looped portion 17. The looped portion 17 could be formed by bending of the strengthened metal core 30 (disclosed in FIG. 2). Referring also to FIG. 10, the looped portion 17 is formed by a looped metal element 171, then one end of the strengthened metal core 30 is connected to or overlapped with the looped metal element 171 (by welding).

Figure 7:
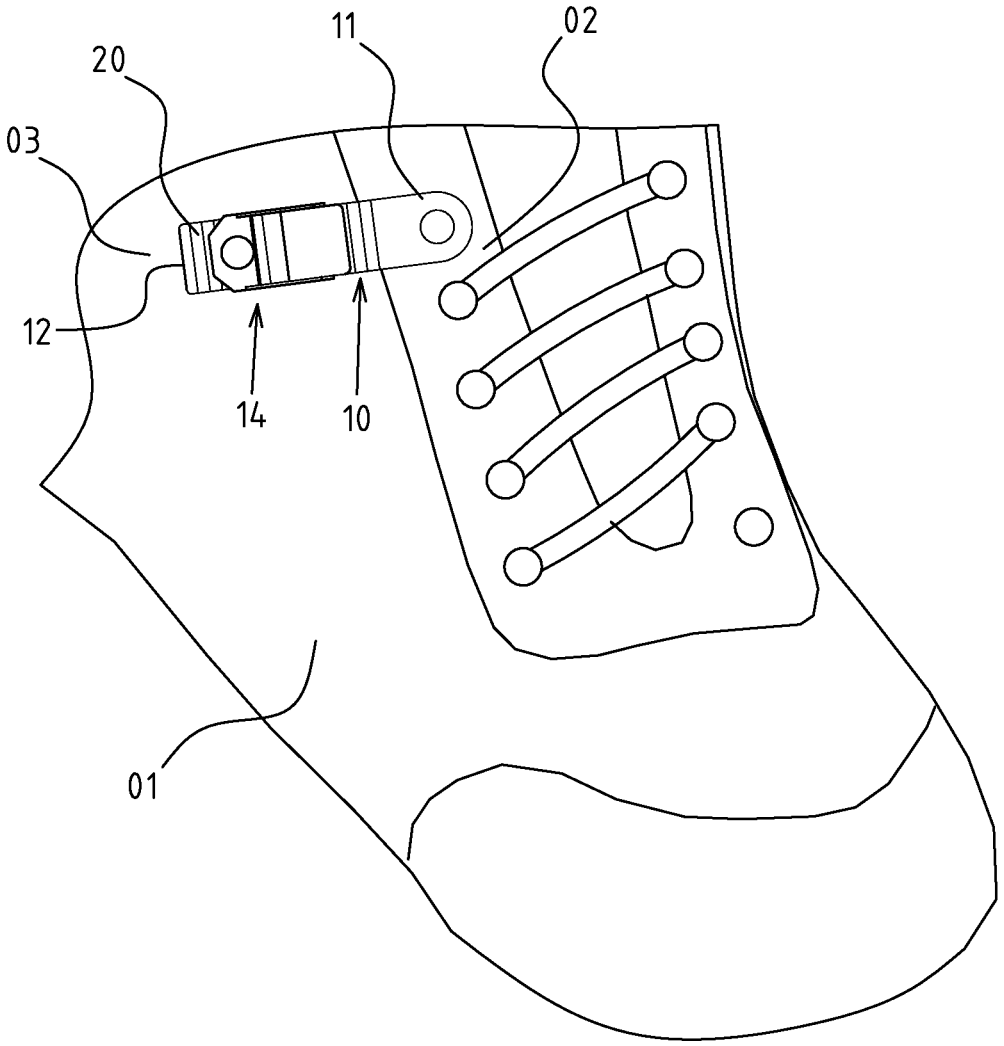
FIG. 7 is a schematic view of the present invention wherein the segment positioning belt is used to fix a ski boot.
Figure 8:
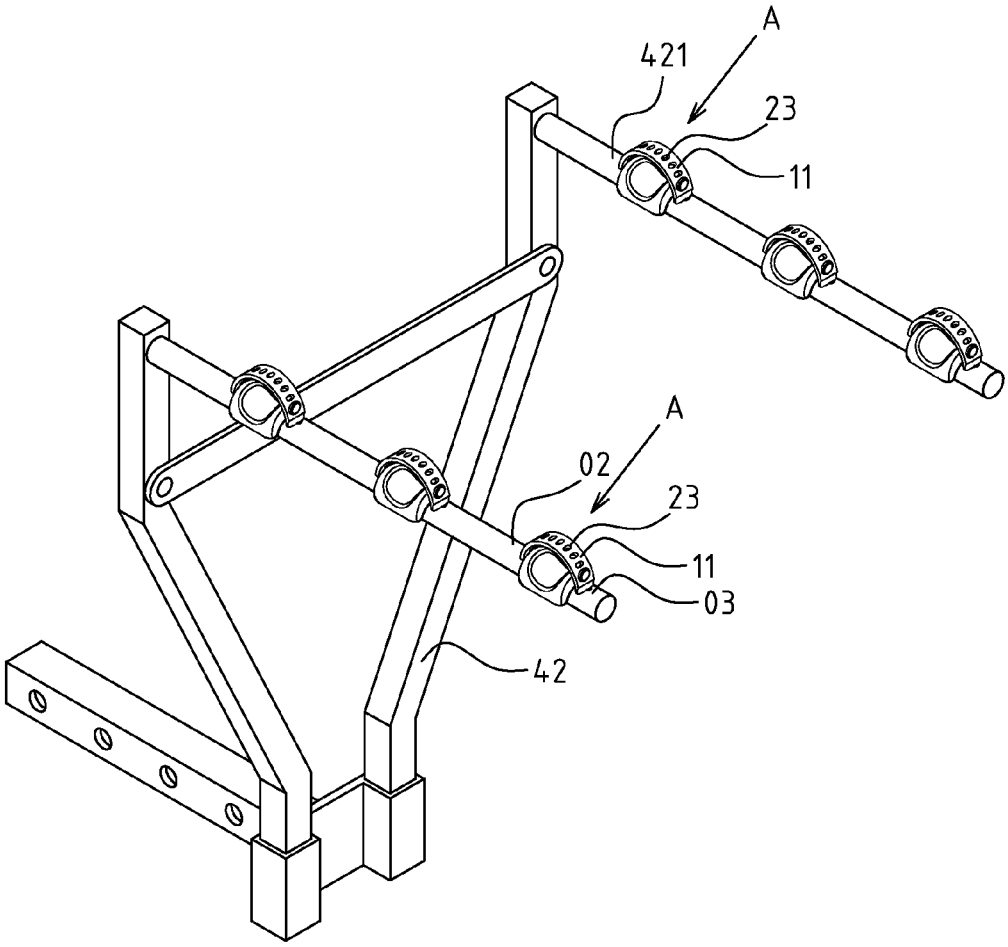
FIG. 8 is a schematic view of the present invention wherein the segment positioning belt is applied to a bicycle carrier.

Based upon above-specified structure, the present invention is operated as follows:

Referring to FIG. 7, the mounting portion 13 at the positioning end 11 of the belt body 10 of the present invention is coupled with the fixed coupling end 02 of the object such as ski boot 01, and the moveable coupling end 03 of the ski boot 01 is coupled with the bottom of the positioning and release controller 14. Next the extension 12 of the belt body 10 passes through the positioning and release controller 14. The segment positioning portion 20 passes through the positioning and release controller 14 in a way that the segment positioning portion 20 and the snapper 15 could be locked firmly. If it is intended to release the tightened belt body 10 from the positioning and release controller 14, users may press the controlling device 16 on the upper end of the positioning and release controller 14 such that the snapper 15 is disengaged from the segment positioning portion 20. Referring also to FIG. 8, another preferred embodiment of the segment positioning belt A, the object hereto is a bicycle carrier 42, which permits the mounting portion 13 of the positioning end 11 to be coupled with its fixed coupling end 421. The segment positioning portion 20 is located by perforation for tightening the bicycle.

Figure 11:
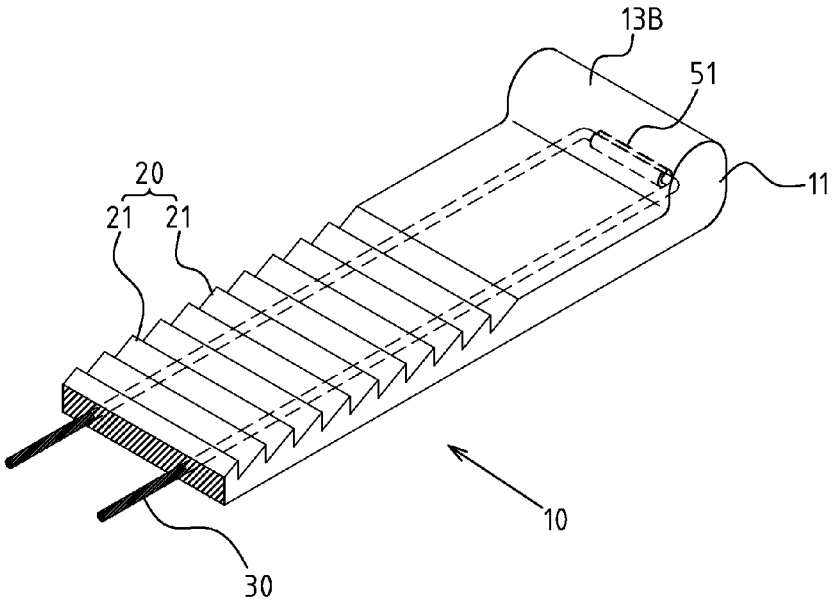
FIG. 11 is a schematic view of the present invention wherein the mounting portion has an expanded bulge.
Figure 12:
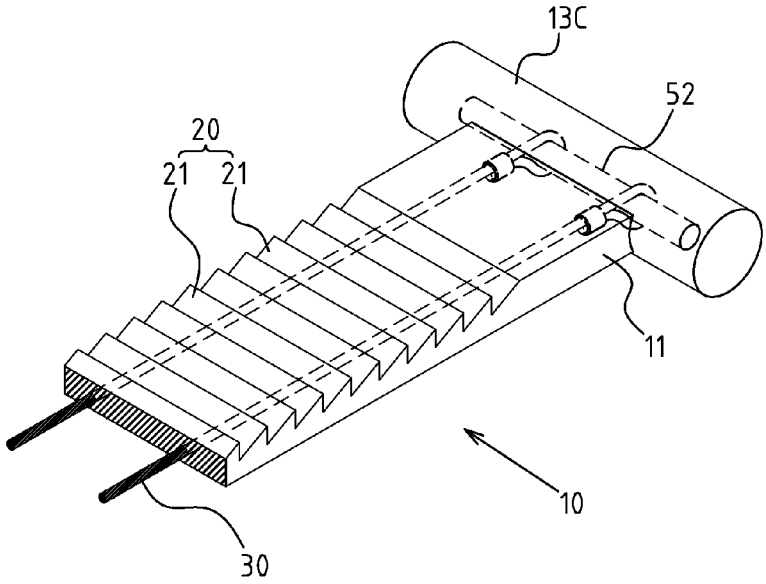
FIG. 12 is another schematic view of the present invention wherein the mounting portion has an expanded bulge.

Referring also to FIGS. 11 and 12, the mounting portions 13B, 13C on the positioning end 11 of the belt body 10 have an expanded bulge, into which a core tube 51 or core bar 52 is buried, allowing to connect firmly one end of the strengthened metal core 30, thus further enhancing the positioning state of the strengthened metal core 30.

I claim:

1. A segment positioning belt comprising:

a flexible belt body having a positioning end and an extension, said positioning end having a mounting portion, said flexible belt body having a shape of an elongated strip, said flexible belt body formed of a rubber or polymeric material;

a plurality of segment positioning portions positioned in spaced relation to each other along said extension; and a metal core integrally formed into said flexible belt body, said metal core having an elongated shape, said metal core extending within said positioning end and said extension of said flexible belt body, said mounting portion having a perforated hole, said metal core having a looped portion at an end thereof corresponding to said mounting portion such that said mounting portion is surrounded by said looped portion.

2. The segment positioning belt of claim 1, further comprising:

a positioning and release controller positioned at a location along said belt body, said positioning and release controller having a snapper and a controlling device, said snapper suitable for embedding into one of said plurality of segment positioning portions, said controlling device cooperative with said snapper so as to position or to release said snapper.

3. The segment positioning belt of claim 1, said plurality of segment positioning portions having a toothed pattern, each of said plurality of segment positioning portions having a tip edge having a length less than a width of said flexible belt body, said belt body having a pair of flanged portions respectively at opposite sides thereof and adjacent opposite ends of said tip edge, said metal core extending through said pair of flanged portions.

4. The segment positioning belt of claim 1, said plurality of segment positioning positions comprising plurality of perforated holes.

5. The segment positioning belt of claim 1, said metal core being a steel rope.

6. The segment positioning belt of claim 1, said looped portion having a looped metal element.

7. The segment positioning belt of claim 6, one end of said metal core being connected to said looped metal element.

8. A segment positioning belt comprising:

a flexible belt body having a positioning end and an extension, said positioning end having a mounting portion, said flexible belt body having a shape of an elongated strip, said flexible belt body formed of a rubber or polymeric material;

a plurality of segment positioning portions positioned in spaced relation to each other along said extension; and a metal core integrally formed into said flexible belt body, said metal core having an elongated shape, said metal core extending within said positioning end and said extension of said flexible belt body, said mounting portion being an expanded bulge, said expanded bulge having a core bar buried therein, said core bar connected firmly to one end of said metal core.

* * * * *